US012110633B2

(12) United States Patent
Zheng et al.

(10) Patent No.: US 12,110,633 B2
(45) Date of Patent: Oct. 8, 2024

(54) METHOD FOR MAKING BURNOUT FABRIC

(71) Applicant: Shanghai Press Intimates Co., Ltd., Shanghai (CN)

(72) Inventors: Tao Zheng, Shanghai (CN); Fang Bao, Shanghai (CN)

(73) Assignee: Shanghai Press Intimates Co., Ltd., Shanghai (CN)

( * ) Notice: Subject to any disclaimer, the term of this patent is extended or adjusted under 35 U.S.C. 154(b) by 320 days.

(21) Appl. No.: 17/595,053

(22) PCT Filed: Nov. 11, 2019

(86) PCT No.: PCT/CN2019/117197
§ 371 (c)(1),
(2) Date: Nov. 8, 2021

(87) PCT Pub. No.: WO2020/228277
PCT Pub. Date: Nov. 19, 2020

(65) Prior Publication Data

US 2022/0220668 A1 Jul. 14, 2022

(30) Foreign Application Priority Data

May 10, 2019 (CN) ..... 201910410477.X

(51) Int. Cl.

| | |
|---|---|
| ***D06Q 1/02*** | (2006.01) |
| ***D03D 15/47*** | (2021.01) |
| ***D06P 1/48*** | (2006.01) |
| ***D06P 1/673*** | (2006.01) |

(52) U.S. Cl.
CPC ..... *D06Q 1/02* (2013.01); *D03D 15/47* (2021.01); *D06P 1/48* (2013.01); *D06P 1/67316* (2013.01); *D10B 2201/02* (2013.01); *D10B 2331/04* (2013.01); *D10B 2401/021* (2013.01); *D10B 2401/022* (2013.01)

(58) Field of Classification Search
CPC ..... D06D 15/47; D06Q 1/02
See application file for complete search history.

(56) References Cited

U.S. PATENT DOCUMENTS

| | | | | |
|---|---|---|---|---|
| 4,417,897 | A * | 11/1983 | Stahl | D06P 5/12 8/481 |
| 4,806,407 | A * | 2/1989 | Skinner | C08L 81/02 428/364 |
| 4,855,411 | A * | 8/1989 | Thompson | C09B 62/507 534/602 |
| 2013/0047350 | A1* | 2/2013 | Genisot | D06P 5/02 8/446 |
| 2014/0234623 | A1* | 8/2014 | Bates | C08L 67/02 428/401 |
| 2019/0062974 | A1* | 2/2019 | Yu | C08G 63/183 |

* cited by examiner

*Primary Examiner* — Thomas T Pham
(74) *Attorney, Agent, or Firm* — Wang Law Firm, Inc.

(57) ABSTRACT

A method for making a burnout fabric includes: (1) pre-treating a greige fabric; (2) processing the pre-treated greige fabric with a burnout paste containing sulfuric acid, synthetic gum tragacanth, and sodium alginate; and (3) post-treating the greige fabric after the burnout treatment to obtain a burnout fabric. The method according to the present invention is simple in process, low in cost, and easy to implement, and the burnout fabric obtained thereby has an attractive and clear pattern, featuring a three-dimensional effect and a high quality.

6 Claims, No Drawings

METHOD FOR MAKING BURNOUT FABRIC

TECHNICAL FIELD

The present invention relates to the field of weaving, more particularly, to a method for making a burnout fabric.

BACKGROUND ART

Burnout is a printing process where a fabric composed of two or more fibers, such as cotton, viscose, hemp, silk, nylon, and polyester, undergoes corrosive chemicals applied on its surface, for example, sulfuric acid and AlCl3, and is dried and treated to dissolve particular fibers to form a pattern, generally used for velvet fabrics. Such a pattern is either in a concavo-convex order or a semi-transparent pattern against a more solidly woven design, and is thus highly decorative. Alternatively, it is also possible to add a suitable resistant dye to a printing paste, coloring particular fibers while dissolving other fibers, to obtain a colorful burnout effect.

At present, the burnout printing can be either direct printing or anti-dye printing. However, in the production process, restricted by the process technique, the burnout fabric often has problems such as insufficient transparency of the burnout portion, an unclear outline of the pattern, excessive patterns, imperfect patterns, or broken threads, which affect the overall quality of the burnout fabric.

SUMMARY OF THE INVENTION

It is an object of the present invention to provide a method for making a burnout fabric, thereby addressing the defects in the prior art.

In particular, the above object is realized in the present invention by implementing the following technical solution.

A method for making a burnout fabric, including the steps of: (1) pretreating a greige fabric; (2) processing the pretreated greige fabric with a burnout paste containing sulfuric acid, synthetic gum tragacanth, and sodium alginate; and (3) subjecting the greige fabric after the burnout treatment to a posttreatment to obtain a burnout fabric.

In an embodiment of the present invention, in step (1), the greige fabric is obtained by subjecting a core-spun yarn to spooling, heat setting twisting, warping, quilling, sizing, and weaving sequentially.

In an embodiment of the present invention, the core-spun yarn includes a hydrophobic polyester filament as a yarn core wrapped with a hydrophilic cotton fiber; a twist factor of the core-spun yarn ranges from 300 to 450; a cotton coverage of the core-spun yarn ranges from 43% to 48%.

In an embodiment of the present invention, a vacuum heat setting pot is used as an apparatus for heat setting; the vacuum heat setting pot has a degree of vacuum of 1 to 2 atmospheres, a temperature of 90° C. to 100° C., and a twist stability rate of 60% to 80% for an inner layer and 75% to 85% for an outer layer.

In an embodiment of the present invention, the sizing is a high-temperature sizing with simultaneous filtration and coating.

In an embodiment of the present invention, in step (1), the pretreatment includes stitching, washing with water, oxygen bleaching, and stoving the greige fabric for the first time.

In an embodiment of the present invention, in step (2), the burnout paste includes 30-50 parts by weight of 98% sulfuric acid, 40-60 parts by weight of the synthetic gum tragacanth, and 5-15 parts by weight of the sodium alginate.

In an embodiment of the present invention, in step (3), the posttreatment includes stoving for the second time, steaming, washing, and drying.

In an embodiment of the present invention, the steaming is performed at a temperature of 108 to 112° C. for 4 to 6 minutes.

In an embodiment of the present invention, the washing is performed at 45-50° C. for 13-17 minutes with an alkaline washing solution.

The method for making a burnout fabric according to the present invention is advantageous over the prior art in that:

(1) the method of the present invention is simple in process, easy to implement, and low in cost, without hazardous chemicals throughout the process, so there is no danger to an operator or adverse effect on the environment; and (2) the method of the present invention produces a burnout fabric with high quality, featuring a clear outline of a pattern, no stain bleeding, an exactly desirable number of patterns, no broken threads, an appealing look, and a perfect match with a printing plate.

DETAILED DESCRIPTION OF THE INVENTION

For the purpose that the object, features and effects of the present invention can be fully understood, a detailed description will be given below with reference to specific embodiments, but the invention is not limited thereto. The process herein employs conventional methods or apparatus in the art, except as described below.

In view of the problems existing in the conventional process for making a burnout fabric, the present invention make an improvement on such a basis and provide a method for making a burnout fabric. The method includes:

(1) pretreating a greige fabric; (2) processing the pretreated greige fabric with a burnout paste containing sulfuric acid, synthetic gum tragacanth, and sodium alginate; and (3) subjecting the greige fabric after the burnout treatment to a posttreatment to obtain a burnout fabric.

In a preferred embodiment, the method for making a burnout fabric herein includes the following steps.

In the first step, a greige fabric is pretreated. The available greige fabric, for example, a polyester/cotton core-spun white fabric, or a polyester/cotton blend fabric, can be adopted in the method herein.

To facilitate the subsequent burnout treatment and to ensure good transparency of the burnout portion, the present invention optimizes the weaving of the greige fabric. In the weaving method, the core-spun yarn has hydrophobic polyester filaments as a yarn core wrapped with hydrophilic cotton fibers. The twist factor of the core-spun yarn ranges from 300 to 450, and a cotton coverage of the core-spun yarn ranges from 43% to 48%. It is found that the core-spun yarn with hydrophobic polyester filaments as the yarn core wrapped with hydrophilic cotton fibers can provide the resultant burnout fabric with good elasticity. The twist factor of core-spun yarn is highly related to the quality of the burnout fabric. In the case of a too small twist factor, this leads to a not smooth enough hand feeling of the filament after the burnout treatment, far from a bolting silk style; moreover, after the filament twisting, the product is easy to fluff, and the service life is reduced; in the process of weaving greige fabric, the outer cotton-spun part is also prone to pilling due to friction. In the case of a too large twist factor, kinky yarns tend to form in weaving. Therefore, the twist factor of the core-spun yarn herein is selected to be 300-450, ensuring a long service life and avoiding problems such as pilling and kinky yarn. In addition, the cotton coverage of the core-spun yarn is selected to be 43%-48%, so that the final product is facilitated to have patterns with strong 3D effects.

In particular, the method for weaving a greige fabric herein includes the following steps.

(a) Spooling, Uniformity Check, and Removal of Spinning Defects

Because the core-spun yarn has many defects and the polyester filament is relatively smooth, it's preferable to use a card-wire yarn clearer on a spooler to improve the efficiency of removing yarn defects. The card wires are preferably spaced at 0.3-0.4 mm. The joint takes a form of a weaving knot, which is required to be small, tight, and firm to prevent unknotting. The spooling tension must be proper because a too strong spooling tension may cause a bobbin to be wound tightly and affect the setting twisting effect of an inner layer; on the contrary, if the bobbin is wound loose, the quality of the bobbin to be formed after setting twisting is reduced, and this increases the difficulty of warping and unwinding. In this step, a double-tappet motion is used, because, in this way, two times of leveling of heddles are carried out to stagger properly, which can not only reduce the friction between warps and between a warp and a heddle, reducing the broken ends of warps in weaving, but also improve the sharpness of shed and reduce three-tappet defects.

The warp and the weft of the burnout fabric are similar in their tightness and density, the weft shrinkage of the burnout fabric is larger than that of a general pure cotton plain weave fabric, and the polyester filament is smooth and easy to stretch. If a temple device has a poor effect on the fabric surface extension, it is very easy to cause broken edges or temple defects in the weaving, therefore, a higher requirement is imposed on the temple device. Herein, the temple licker-in roller is a copper-ring temple licker-in roller in 16 pieces of licker-in ring with 1 mm pins. In addition, an iron sheet of a fabric-covered licker-in roller is required to be sharp, and the spring force of the fabric-covered roller is also required to be large, to ensure that the temple device has sufficient stretching force on the fabric surface during weaving.

The temperature ranges from 20° C. to 28° C. and the relative humidity ranges from 60% to 75% in the weaving plant. It is found that this temperature range maximally stabilizes the properties of the fabric and minimizes yarn breakage without causing deformation, especially brittle failure; the relative humidity range reduces static electricity generation and avoids fuzzing, and the humidity range is beneficial for human comfort.

(b) Heat Setting Twist

This step is critical to the weaving of the greige fabric. The yarn core of the polyester cotton core-spun yarn used for the burnout fabric herein is a polyester filament, which has good elasticity, and the resultant yarn has a high twist, so in the weaving process, a slight loose in the warp and weft tensions is likely to cause kink yarns and affect the fabric quality. Therefore, the warp and weft core-spun yarns used in burnout fabric must be subjected to heat setting twist after spooling before warping and quilling and then for sizing and weaving. Through the heat setting twist treatment, loose wefts, weft shrinkage, and loops can be reduced, and the weaving performance and quality can be improved.

In the present invention, a vacuum heat setting pot is used for heat setting, and the twist setting process requires that the core-spun yarn bobbin weigh 1200 g, the vacuum degree of the heat setting pot be 1-2 atmospheres, the temperature be 90° C.-100° C., the twist stability rate be 60%-80% in the inner layer and 75%-85% in the outer layer. The combination of the aforementioned parameters can achieve an optimal effect in terms of reducing loose wefts, weft shrinkage, and loops.

(c) Warping and Quilling

To reduce the tension unevenness, tension rings with different weights can be arranged in sections according to the data measured by a tension side tester when a high-speed warping machine is used to replace the bobbins in batches. It may not be necessary to configure the tension rings in sections if the bobbins are replaced in sections because the diameters of the bobbins are different, and the tension difference is significant. In the present invention, the tension rings are configured in sections, for example, in three sections, weighing 8 grams in a front section, 7 grams in a middle section, and 6 grams in a rear section; if not segmented, all the tension rings weigh 9 grams.

(d) Sizing

By sizing the core-spun yarn, the cotton fiber and polyester filament are bound tightly, a layer of sizing film is coated on a surface of the core-spun yarn, which not only improves the strength of the core-spun yarn, but also increases the wear resistance against weaving. In the present invention, the yarn core of the core-spun yarn is a hydrophobic polyester filament and is wrapped with a hydrophilic cotton fiber, moreover, the resultant yarn has a high degree of twist, so the inventor(s) adopt simultaneous sizing filtration and coating, double sizing rollers (heavy and light, front and rear), a high temperature (from 55 to 65 degrees centigrade) in the sizing treatment, and adhere to a processing standard of low sizing, low moisture regains, low tension, and low elongation. The surface of the sizing rollers should have good elasticity, so rubber ones are preferred.

The size used for sizing may be a mixture of modified corn starch with PVC (polyvinyl chloride) and CMC (sodium carboxymethyl cellulose), or a chemical size mainly composed of PVC, CMC, and PAM (polyacrylamide). Preferably, the size used may be a mixture of 55% by weight corn starch, 30% by weight PVC, and 15% by weight CMC.

(e) Weaving

The reed used for weaving has a great influence on the final greige fabric, and catering to the uniform arrangement of the warp and weft of the burnout fabric, a steel reed with a higher reed number is used in the present invention, and the number of the reed made by the manufacturer is not less than 190, which has a significant effect on improving the product quality. In actual production, it is preferable to pass one warp per reed and at most two warps per reed when passing the reed.

The double-layer cotton-polyester fabric obtained after weaving is the greige fabric used for making the burnout fabric according to the present invention. After obtaining the greige fabric, the greige fabric is pre-treated. In particular, the pre-treatment includes the following steps.

Firstly, stitching: to make sure that the greige fabric is difficult to unravel and to be strong and durable during the burnout treatment, it is preferable to adopt a polyester thread for stitching.

Secondly, washing with water: the stitched greige fabric is rinsed in clean water, for example, at 45° C. for 60 minutes.

Thirdly, oxygen bleaching: an oxygen bleaching method (using hydrogen peroxide and color bleaching powder) is adopted, the water-washed greige fabric is put into an oxygen bleaching agent, where the temperature of the oxygen bleaching agent is about 80-88° C., and is rinsed for 30-45 minutes.

Finally, first stoving: the rinsed fabric is placed into a stoving room, and the fabric is flattened for stoving, for example, at about 92° C. for 15 minutes.

In the second step, the burnout treatment is carried out.

The pretreated greige fabric is treated with a burnout paste. The inventor(s) of the present invention have improved the composition of the burnout paste. In the present invention, the burnout paste is obtained by puffing 30-50 parts by weight of 98 wt % sulfuric acid, 40-60 parts by weight of synthetic gum tragacanth, and 5-15 parts by weight of sodium alginate at 30-45° C. for, for example, 12 hours. The use of the burnout paste of the above-mentioned composition enables burnout printing to be thorough and easy to wash out, and is suitable for removing polyester fibers in various fiber interwoven/blended fabrics or fleece fabrics, thereby achieving three-dimensional or other special printing effects. Among them, the synthetic gum tragacanth is known by its chemical name, i.e., hydroxyethyl saponin gum.

After preparation of the burnout paste, a burnout plate having a desired pattern is placed on the greige fabric, the white glue paste is applied to the edges of the burnout pattern, and finally the burnout paste is introduced into the burnout pattern. After formation of the burnout pattern, for example, after half an hour, the burnout paste is removed.

In the third step, the posttreatment is carried out. After the burnout treatment, the greige fabric is subjected to the posttreatment, specifically including the following steps.

Firstly, second stoving: the cleaned fabric is again put into the stoving room for stoving, for example, at 100° C. for 5 minutes.

Secondly, steaming: the fabric subjected to the second stoving is steamed, for example, at a temperature of 108° C. to 112° C., at a pressure of 1 atmosphere, for 4 to 6 minutes.

Thirdly, washing: the fabric is washed with an alkaline wash solution at 45° C.-50° C. for 13-17 minutes. Examples of the alkaline wash solution are soaps, washing powders, etc.

Finally, drying: the washed fabric was taken out and air-dried to obtain the burnout fabric.

Through the posttreatment, especially the posttreatment under the above-mentioned conditions, it is possible to render a clear contour of the burnout portion of the burnout fabric, the convex-concave effect is better, and a desirable tightness is realized, avoiding easy-to-loosen threads, over-tightness, or obscure burnout effects.

The total tightness of the burnout fabric obtained through the method of the invention is 65-75% with a warp tightness of 45-55% and a weft tightness of 40-55%. It should be noted that the tightness of the burnout fabric includes two concepts, i.e., the tightness of the core yarn of the fabric and the tightness of a screen net of the fabric. If the tightness of the fabric is too high, the weaving production may be difficult, and if the tightness of the fabric is too low, the warp and the weft are easy to shift in the screen net. As can be seen from the tightness of the burnout fabric of the present invention, the burnout fabric of the present invention has excellent softness, a clear burnout pattern, and a distinct concave-convex effect.

The various raw materials and substances used in the process of the present invention are commercially available without special requirements unless otherwise specified.

EXAMPLES

The invention is further illustrated by way of the following examples, but not limited to the scope of the described examples. The experimental methods for which specific conditions are not specified in the following examples are determined according to conventional methods and conditions or product's instructions.

Example 1: The Weaving of the Greige Fabric (a) Spooling: a polyester/cotton core-spun yarn having a twist factor of 300 and a cotton coverage of 43% was used and subjected to a uniformity check, and a card wire yarn cleaner with card wires spaced at 0.3 mm was used to remove the spinning defects.

(b) Heat setting: a vacuum heat setting pot was used, the heat setting pot had a vacuum degree of 1 atmosphere, a temperature of 90° C., a twist stability of 78% in the inner layer and 80% in the outer layer.

(c) Warping and quilling: the tension rings of a warping machine were arranged in sections, weighing 8 grams in a front section, 7 grams in a middle section, and 6 grams in a rear section (d) Sizing: double sizing rollers were used, the sizing was conducted at about 55° C., wherein the size is composed of corn starch 55% by weight, PVC 30% by weight, and CMC 15% by weight.

(e) Weaving: the reed number was 190, preferably passing one warp per reed, and the greige fabric was weaved on a machine.

Example 2: The Weaving of the Greige Fabric (a) Spooling: a polyester/cotton core-spun yarn having a twist factor of 360 and a cotton coverage of 45% was used and subjected to a uniformity check, and a card wire yarn cleaner with card wires spaced at 0.3 mm was used to remove the spinning defects.

(b) Heat setting: a vacuum heat setting pot was used, the heat setting pot had a vacuum degree of 2 atmospheres, a temperature of 93° C., a twist stability of 75% in the inner layer and 79% in the outer layer.

(c) Warping and quilling: the tension rings of a warping machine were arranged in sections, weighing 8 grams in a front section, 7 grams in a middle section, and 6 grams in a rear section (d) Sizing: double sizing rollers were used, the sizing was conducted at about 55° C., wherein the size is composed of corn starch 55% by weight, PVC 30% by weight, and CMC 15% by weight.

(e) Weaving: the reed number was 190, preferably passing one warp per reed, and the greige fabric was weaved on a machine.

Example 3: The Weaving of the Greige Fabric (a) Spooling: a polyester/cotton core-spun yarn having a twist factor of 450 and a cotton coverage of 48% was used and subjected to a uniformity check, and a card wire yarn cleaner with card wires spaced at 0.3 mm was used to remove the spinning defects.

(b) Heat setting: a vacuum heat setting pot was used, the heat setting pot had a vacuum degree of 1 atmosphere, a temperature of 100° C., a twist stability of 80% in the inner layer and 81% in the outer layer.

(c) Warping and quilling: the tension rings of a warping machine were arranged in sections, weighing 8 grams in a front section, 7 grams in a middle section, and 6 grams in a rear section (d) Sizing: double sizing rollers were used, the sizing was conducted at about 55° C., wherein the size is composed of corn starch 55% by weight, PVC 30% by weight, and CMC 15% by weight.

(e) Weaving: the reed number was 190, preferably passing one warp per reed, and the greige fabric was weaved on a machine.

Example 4: The Manufacture of the Burnout Fabric (1) Pretreatment: the greige fabric was stitched with a polyester thread, the stitched greige fabric was rinsed in clean water at 45° C. for 60 minutes and in an oxygen bleaching agent at about 80° C. for 45 minutes, and then the greige fabric was passed into a stoving room at a temperature of about 92° C. for 15 minutes.

(2) Burnout treatment: 98 wt % sulfuric acid, synthetic gum tragacanth and sodium alginate were mixed in a weight ratio of 30:60:10 and puffed for 12 hours to obtain a burnout paste, a burnout plate was placed on the pretreated greige fabric, the white glue paste was applied to the edges of the burnout pattern, and finally the burnout paste was introduced into the burnout pattern. After formation of the burnout pattern, the burnout paste was removed.

(3) Posttreatment: the cleaned fabric was sent to a stoving room for stoving at 100° C. for 5 minutes, then steamed at 108° C. and 1 atmosphere for 6 minutes, followed by washing with washing powder at 45° C. for 17 minutes, and air-dried to obtain the burnout fabric.

Example 5: The Manufacture of the Burnout Fabric (1) Pretreatment: the greige fabric was stitched with a polyester thread, the stitched greige fabric was rinsed in clean water at 45° C. for 60 minutes and in an oxygen bleaching agent at about 83° C. for 45 minutes, and then the greige fabric was passed into a stoving room at a temperature of about 92° C. for 15 minutes.

(2) Burnout treatment: 98 wt % sulfuric acid, synthetic gum tragacanth and sodium alginate were mixed in a weight ratio of 40:50:6 and puffed for 12 hours to obtain a burnout paste, a burnout plate was placed on the pretreated greige fabric, the white glue paste was applied to the edges of the burnout pattern, and finally the burnout paste was introduced into the burnout pattern. After formation of the burnout pattern, the burnout paste was removed.

(3) Posttreatment: the cleaned fabric was sent to a stoving room for stoving at 100° C. for 5 minutes, then steamed at 110° C. and 1 atmosphere for 5 minutes, followed by washing with washing powder at 46° C. for 15 minutes, and air-dried to obtain the burnout fabric.

Example 6: The Manufacture of the Burnout Fabric (1) Pretreatment: the greige fabric was stitched with a polyester thread, the stitched greige fabric was rinsed in clean water at 45° C. for 60 minutes and in an oxygen bleaching agent at about 88° C. for 45 minutes, and then the greige fabric was passed into a stoving room at a temperature of about 92° C. for 15 minutes.

(2) Burnout treatment: 98 wt % sulfuric acid, synthetic gum tragacanth and sodium alginate were mixed in a weight ratio of 50:40:15 and puffed for 12 hours to obtain a burnout paste, a burnout plate was placed on the pretreated greige fabric, the white glue paste was applied to the edges of the burnout pattern, and finally the burnout paste was introduced into the burnout pattern. After formation of the burnout pattern, the burnout paste was removed.

(3) Posttreatment: the cleaned fabric was sent to a stoving room for stoving at 100° C. for 5 minutes, then steamed at 112° C. and 1 atmosphere for 6 minutes, followed by washing with washing powder at 50° C. for 13 minutes, and air-dried to obtain the burnout fabric.

The above-mentioned examples are preferred embodiments of the present invention, but the embodiments of the present invention are not limited thereto. Without departing from the spirit and principle of the present invention, any other substitutions, modifications, combinations, changes, and simplifications are deemed as an equivalent replacement and are all included in the scope of the present invention.

What is claimed is:

1. A method for making a burnout fabric, comprising the steps of:

(1) pretreating a greige fabric, which comprises: stitching, washing with water, oxygen bleaching, and stoving the greige fabric for the first time;

(2) performing burnout treatment on the pretreated greige fabric by means of a burnout paste containing sulfuric acid, synthetic gum tragacanth, and sodium alginate; and (3) performing post-treatment on the greige fabric that has experienced the burnout treatment, to obtain a burnout fabric, the post-treatment including: stoving for the second time, steaming, washing, and drying;

wherein in step (1), the greige fabric is obtained by subjecting a core-spun yarn to spooling, heat setting twisting, warping, quilling, sizing, and weaving process, sequentially, and wherein the core-spun yarn comprises a hydrophobic polyester filament as a yarn core wrapped with a hydrophilic cotton fiber; a twist factor of the core-spun yarn ranges from 300 to 450; a cotton coverage of the core-spun yarn ranges from 43% to 48%.

2. The method for making a burnout fabric according to claim 1, wherein a vacuum heat setting pot is used as an apparatus for heat setting; wherein the vacuum heat setting pot has a degree of vacuum of 1 to 2 atmospheres, a temperature of 90° C. to 100° C., and a twist stability rate of 60% to 80% for an inner layer and 75% to 85% for an outer layer.

3. The method for making a burnout fabric according to claim 1, wherein the sizing is a high-temperature sizing with simultaneous filtration and coating.

4. The method for making a burnout fabric according to claim 1, wherein in step (2), the burnout paste comprises 30-50 parts by weight of 98% sulfuric acid, 40-60 parts by weight of the synthetic gum tragacanth, and 5-15 parts by weight of the sodium alginate.

5. The method for making a burnout fabric according to claim 1, wherein the steaming is performed at a temperature of 108 to 112° C. for 4 to 6 minutes.

6. The method for making a burnout fabric according to claim 1, wherein the washing is performed at 45-50° C. for 13-17 minutes with an alkaline wash solution.

* * * * *